US006688583B2

(12) United States Patent
Merrick

(10) Patent No.: US 6,688,583 B2
(45) Date of Patent: Feb. 10, 2004

(54) FENCE POST FINIALS

(75) Inventor: Richard James Merrick, Alda, NE (US)

(73) Assignee: TMC, Inc., Alda, NE (US)

( * ) Notice: Subject to any disclaimer, the term of this patent is extended or adjusted under 35 U.S.C. 154(b) by 201 days.

(21) Appl. No.: 09/753,971

(22) Filed: Jan. 3, 2001

(65) Prior Publication Data

US 2001/0050361 A1 Dec. 13, 2001

Related U.S. Application Data

(60) Provisional application No. 60/174,312, filed on Jan. 3, 2000, and provisional application No. 60/174,311, filed on Jan. 3, 2000.

(51) Int. Cl.[7] ..... E04H 17/00
(52) U.S. Cl. ..... 256/1; 256/19; 256/65.01
(58) Field of Search ..... 256/1, 11, 19, 256/22, 32, 65.01, 65.03, 59; 52/720.2, 301; 403/339, 344, 340, 315–317, 326, 329, 294, 309, 310; D81/378, 379

(56) References Cited

U.S. PATENT DOCUMENTS

| | | | | |
|---|---|---|---|---|
| 3,648,981 | A | 3/1972 | Allen | |
| 3,720,401 | A | 3/1973 | Loch | |
| 3,799,506 | A | 3/1974 | Schwartz | |
| 3,806,095 | A | 4/1974 | Ford | |
| 3,891,189 | A | 6/1975 | Russo | |
| 3,915,434 | A | * 10/1975 | Lister | 256/59 |
| 3,957,250 | A | 5/1976 | Murphy | |
| 3,960,367 | A | 6/1976 | Rogers | |
| 4,103,875 | A | 8/1978 | Glass | |
| 4,240,615 | A | 12/1980 | Sickler | |
| 4,324,388 | A | 4/1982 | Klaser | |
| 4,364,546 | A | 12/1982 | Lyman et al. | |
| D269,209 | S | 5/1983 | Hegarty | |
| 4,602,765 | A | * 7/1986 | Loper et al. | 256/19 |
| 4,667,935 | A | 5/1987 | Moore | |
| 4,722,514 | A | 2/1988 | Pettit | |
| 4,809,955 | A | 3/1989 | Veilleux | |
| 4,883,256 | A | 11/1989 | Hebda | |
| 4,926,785 | A | 5/1990 | Lamson | |
| 4,991,823 | A | 2/1991 | Stanish, Jr. | |
| 5,078,367 | A | 1/1992 | Simpson et al. | |
| 5,149,060 | A | 9/1992 | Boes | |
| 5,150,885 | A | 9/1992 | Leone | |
| 5,192,054 | A | 3/1993 | Sharp | |
| D340,404 | S | 10/1993 | Prezner | |
| 5,301,926 | A | 4/1994 | Sharp | |
| D348,526 | S | 7/1994 | Nowotny | |
| 5,332,196 | A | 7/1994 | Wright | |
| 5,415,380 | A | 5/1995 | Sharp | |
| 5,421,556 | A | 6/1995 | Dodge et al. | |
| 5,529,289 | A | 6/1996 | Lancer, Sr. | |
| 5,531,427 | A | 7/1996 | Quarles | |
| 5,577,710 | A | 11/1996 | Kirby | |
| 5,601,278 | A | 2/1997 | Graber | |
| 5,601,279 | A | 2/1997 | Schwartz et al. | |
| 5,651,534 | A | 7/1997 | Yoder | |

(List continued on next page.)

OTHER PUBLICATIONS

Invention Disclosure Form, James Tommy Lee & Richard James Merrick, Dec. 17, 1999.

(List continued on next page.)

*Primary Examiner*—Lynne H. Browne
*Assistant Examiner*—Michael P. Ferguson
(74) *Attorney, Agent, or Firm*—Frost Brown Todd LLC

(57) ABSTRACT

A finial for placement atop a post and a related method for molding and assembling the finial is provided. The finials have unisex molded halves that are pressure fitted to create a high-gloss finial, which is capable of withstanding variable weather conditions. Further enhancements of the finial design are realized by the finial mold structure, which allows additional supplemental finials/skirts to be connected to the base finial.

6 Claims, 13 Drawing Sheets

U.S. PATENT DOCUMENTS

| | | | | | |
|---|---|---|---|---|---|
| 5,660,376 | A | | 8/1997 | West | |
| 5,702,090 | A | | 12/1997 | Edgman | |
| D391,377 | S | | 2/1998 | Langlie et al. | |
| D399,263 | S | | 10/1998 | Christopher | |
| 5,853,167 | A | * | 12/1998 | West et al. | 256/66 |
| 5,857,664 | A | | 1/1999 | Schauman | |
| 5,927,694 | A | * | 7/1999 | Montepiano | 256/64 |
| 5,931,450 | A | | 8/1999 | Yoder | |
| 5,938,184 | A | | 8/1999 | DeSouza | |
| 6,076,807 | A | * | 6/2000 | Spence | 256/1 |
| 6,123,035 | A | * | 9/2000 | Pfister | 108/180 |
| 6,257,557 | B1 | * | 7/2001 | Anderson et al. | 256/1 |
| 6,382,867 | B2 | * | 5/2002 | Serre | 403/329 |
| 2001/0051071 | A1 | * | 12/2001 | Serre | 403/326 |

OTHER PUBLICATIONS

Invention Disclosure Form, Richard James Merrick, Dec. 17, 1999.

E–mail from Richard James Merrick to Ria Farrell Schalnat, Dec. 22, 1999.

Invention Disclosure for Designs, Dec. 17, 1999.

E–mail from A. Matt Kasap to Ria Farrell Schalnat, Nov. 17, 1999.

* cited by examiner

FENCE POST FINIALS

This is a non-provisional application based upon the earlier filed provisional applications, Serial No. 60/174,311 filed Jun. 3, 2000 and Serial No. 60/174,312 filed Jun. 3, 2000.

BACKGROUND OF THE INVENTION

1. Field of the Invention

The present invention relates to finials, and particularly to decorative fence-post finials and a method of making and assembling these finials.

2. Description of the Related Art

PVC fencing has achieved a measure of popularity against more traditional fencing materials due to its high-gloss appearance, low maintenance, durability, and its lower expense. Typical PVC fencing posts are hollow and open-ended. Therefore, these posts require some protective covering to prevent the open-ended post from being exposed and filling with rain, debris, etc. Should a hollow fence post receive rainwater that later freezes, the fence post may suffer damage from internal pressure as the water freezes and expands.

Simple form plastic fence post tops that serve the single, utilitarian purpose of protecting the PVC fence posts lack the decorative enhancements that are often seen in wood and wrought iron fencing. This restricts the plastic fences from competing against other styles of fencing materials.

The industry has attempted to compensate for the lack of variation by injection molding fence post finials. One-piece molded finials do not, however, allow for ornate finials because the molds are too restrictive in design. Also, the nature of this manufacturing-process restricts the development of more ornate and decorative designs. Molding solid finials in larger sizes, would be impractical to produce. Partially solid finials could be produced but with greatly added material cost, unsatisfactory shrinking as the material cools, and extreme top heaviness. Fully hollow finials are the preferred option. Producing full-hollow finials as one piece, requires a collapsible internal core. This collapsible core, however, would be more expensive to construct and require greater maintenance over standard molds. Further, even with a collapsing core, the decorative design would be limited. The core can only collapse within itself to a certain point. The decorative designs are thus limited to only modest finial designs. Thus, a one-piece finial cannot nearly embody all of the decorative elements that a two-piece can.

Design parameters can be broadened tremendously by molding the fence post tops in two halves (right and left halves). With two halves, the interior can be hollowed out with the only limit being what wall thickness is to remain. With PVC, this wall thickness may be reduced to as little as 0.90 of an inch. The two-half system minimizes the part weight, speeds up cooling and curing time, and allows nesting for packaging; all of which reduce costs. This however, complicates the tooling and raises the costs far above what this limited marketplace can economically justify. The tooling requirement is doubled, by using a right-half and a left-half mold similar to the concept of a distinct "male" mold and a distinct "female" mold for each half of the finial.

Furthermore, the two halves must be combined to make a single cohesive finial. Common practice is to use metal fasteners or glue to assemble plastic parts. Both of these methods detract from the high gloss, smooth, and unblemished appearance desired in the finished finial. The metal fasteners are not acceptable due to their effect on the appearance of the finished parts. The fasteners either show or must be covered/painted. Fasteners also add to the cost and assembly time required for each finial. Gluing adds even more to the cost and assembly time required for each assembly. Besides the cost of the glue and labor involved, two other issues must be considered. One is the EPA hazards and concerns regarding the fumes from the glue. The other is the frequency of dripping on or fingerprinting the halves during the gluing and assembly process, resulting in considerable scrap expense. Blotches, smudges, or glue tracks are not compatible with the cosmetic appearance desired.

SUMMARY OF THE INVENTION

The present invention solves the problems with the previously described convention in the art. In particular, it addresses the problems with providing decorative molded PVC covers/finials that are capable of many diverse looks and that are easy to assemble without resulting in unsightly blemishes. The invention comprises a cover configured for covering an upper end of a post. The cover comprises a collar, for placement upon the upper end of a post, and a protrusion capable of receiving an additional decorative element(s). The additional decorative elements may comprise additional covers or finials. The cover itself may comprise a decorative finial.

The cover may also comprise a lip capable of receiving further decorative elements such as a decorative skirt. The skirt surrounds the lip and comprises two unisex halves that are capable of being joined to each other around the collar.

The covers further comprise two substantially similar, unisex halves wherein the interiors of said unisex halves are capable of affixation to each other. The interiors of the unisex halves further comprise the horizontal displacement on each half of at least one peg and one receptor. Additional peg-receptor pairs may be displaced in vertical, but not necessarily symmetrical, alignment with other peg-receptor pairs along the interior surface of the unisex half. One may combine the unisex halves by engaging the complementary peg-receptor pairs of each unisex half with the other. This combination results in a tight engagement between said complementary pegs and receptors along at least a portion of the engaged pegs and receptors. To combat expansion and shrinkage factors due to multiple conditions (including the weather) once the unisex halves are engaged, the peg-receptor pairs comprise hollow interiors.

Another embodiment of the invention comprises an escape passage for air trapped by the engagement of the peg and its complementary receptor. This may be achieved in a number of ways including displacing a groove along a portion of the interior, hollow surface of the receptor or along the exterior surface of the peg.

All of the decorative elements described above (cover, finials, skirts, etc.) may be injection molded from a variety of materials including polyvinyl chloride.

These and further objects of the present invention will become more apparent from the following description of the preferred embodiment.

BRIEF DESCRIPTION OF THE DRAWINGS

The accompanying drawing incorporated in and forming part of the specification illustrates several aspects of the present invention. In the drawings.

For the purpose of promoting an understanding of the principles of the invention, reference will now be made in detail to the present preferred embodiment to the invention, examples of which are illustrated in the accompanying drawings and specific language will be used to describe the same. It will nevertheless be understood that no limitation of the scope of the invention is thereby intended toward such alterations and further modifications in the illustrated device and such further applications of the principles of the invention as illustrated therein as would normally occur to one skilled in the art to which the invention relates.

DETAILED DESCRIPTION OF THE PREFERRED EMBODIMENT

Figure 1:
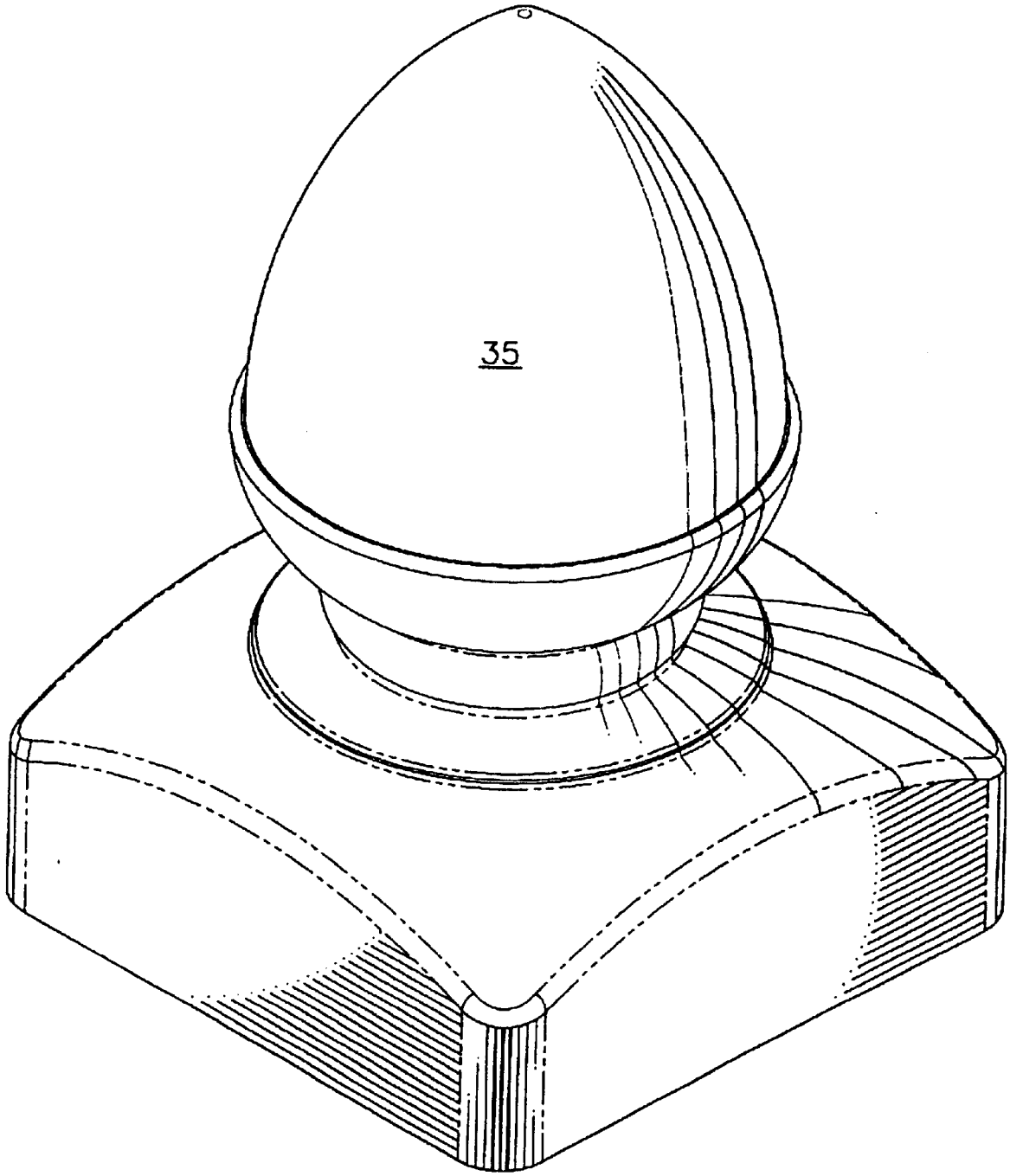
FIG. 1 is a perspective view of an assembled acorn-shaped fence post finial.
Figure 7:
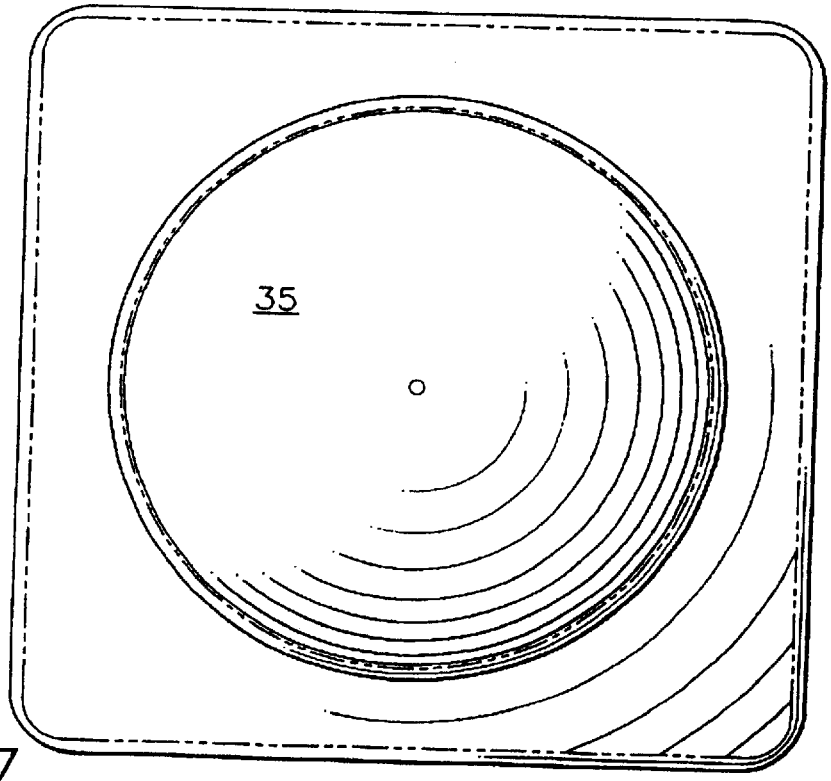
FIG. 7 is a top view of the exterior of an assembled acorn-shaped fence post finial.
Figure 8:
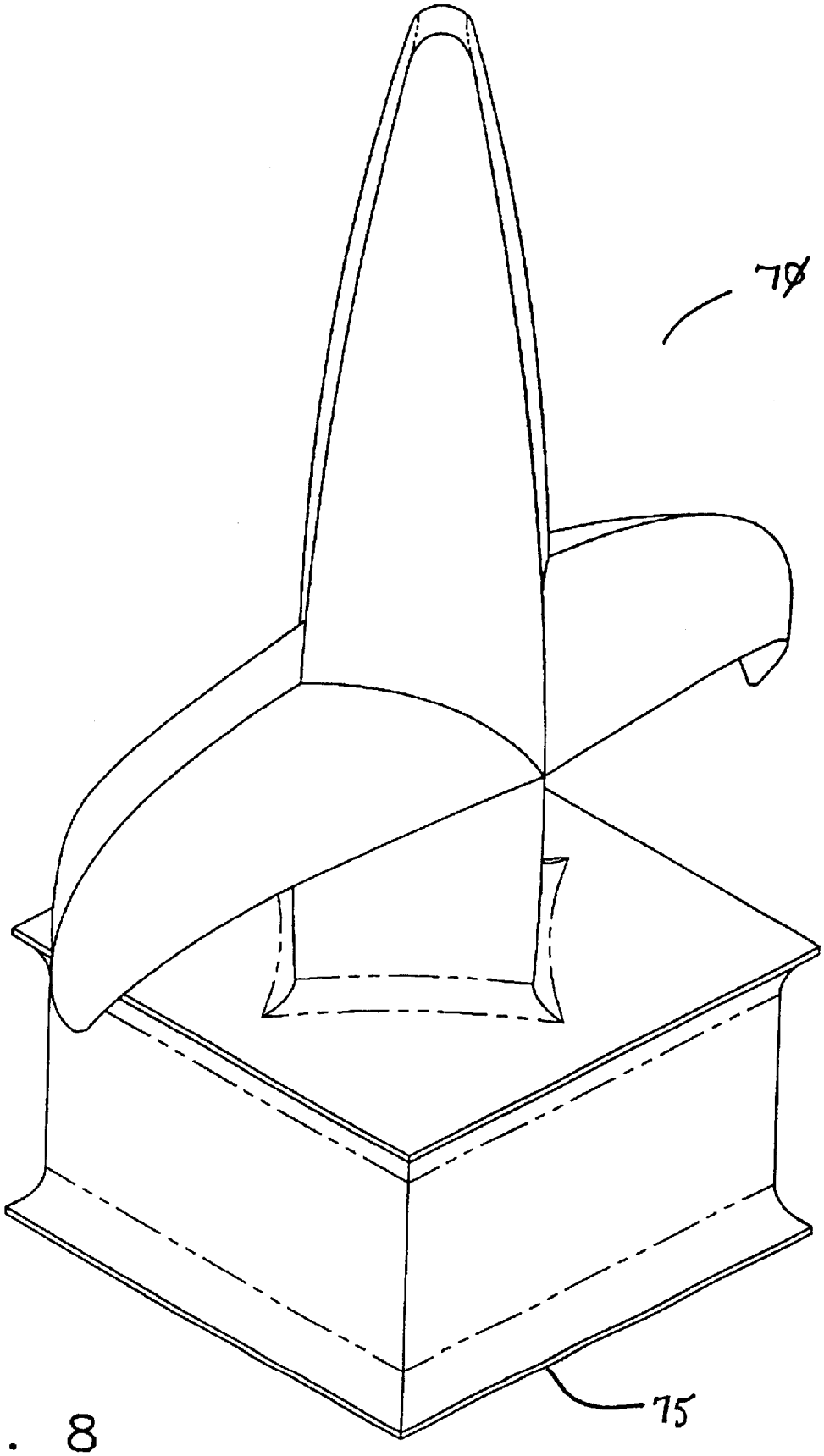
FIG. 8 is an isometric view of the exterior of a fence post finial decorative element.
Figure 9:
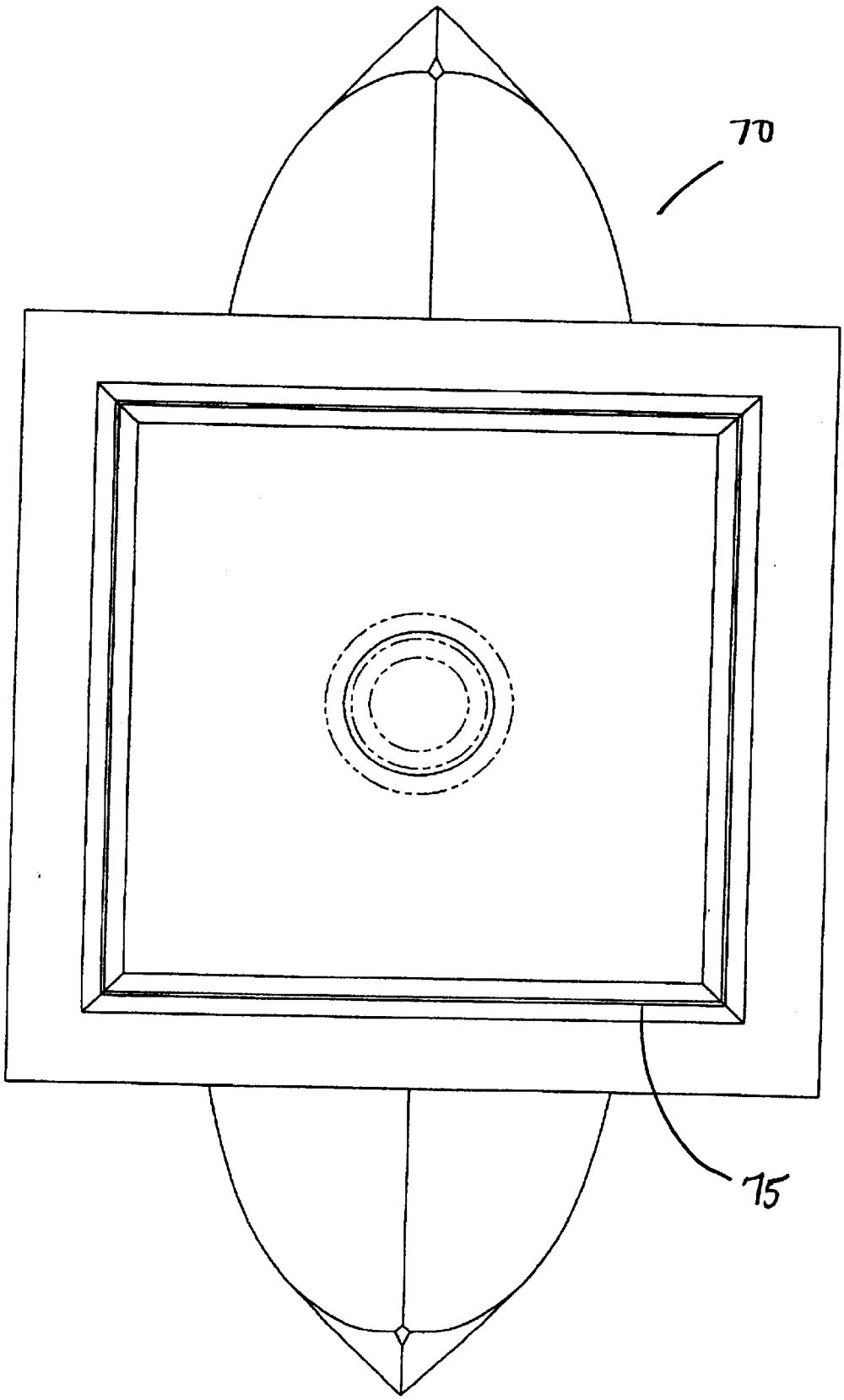
FIG. 9 is a bottom view of the interior of a fence post finial decorative element.
Figure 10:
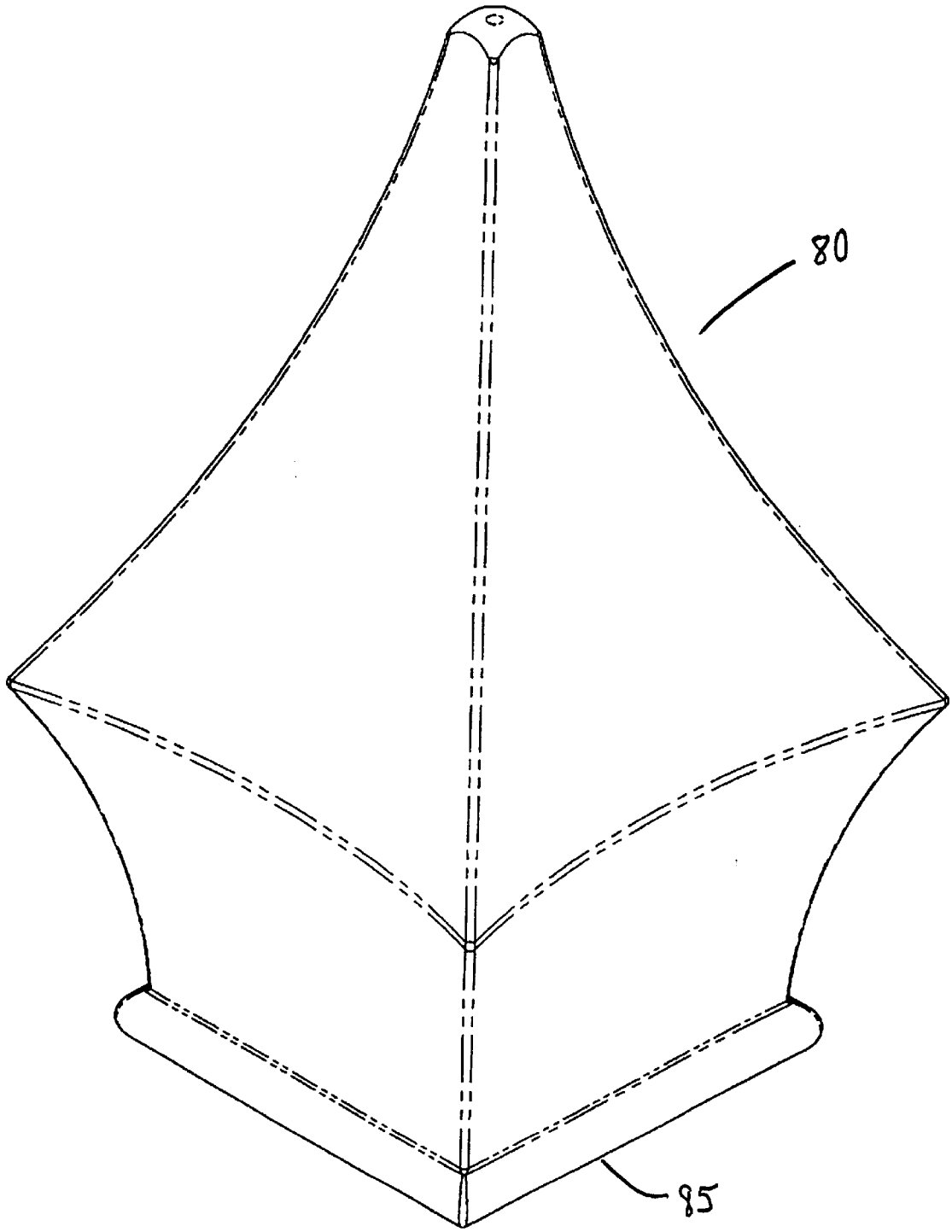
FIG. 10 is an isometric view of the exterior of a fence post finial decorative element.

The presented embodiments of the invention solve the problems with the previously described convention in the art. In particular, they address the problems with providing decorative molded polyvinyl chloride covers/finials that are capable of many diverse looks and that are easy to assemble without resulting in unsightly blemishes. It will, however, be understood that embodiments of the invention may be created from a variety of materials including polyvinyl chloride, other plastics, metal, and more. Molding two unisex halves that are pressure-fitted creates a single finial that has a high gloss, smooth and unblemished appearance as shown in FIGS. 1 and 7. This unique method of molding and assembling the finials has the added advantage of extending the life of the finial through varied weather conditions. The molds are further designed to allow the stacking of different finials on top of the other to create different looks (See FIGS. 16–17). This allows the user to create an endless variety of decorative combinations. The finished finials may be assembled on fence posts with minimal labor and little or no additional materials.

Figure 2:
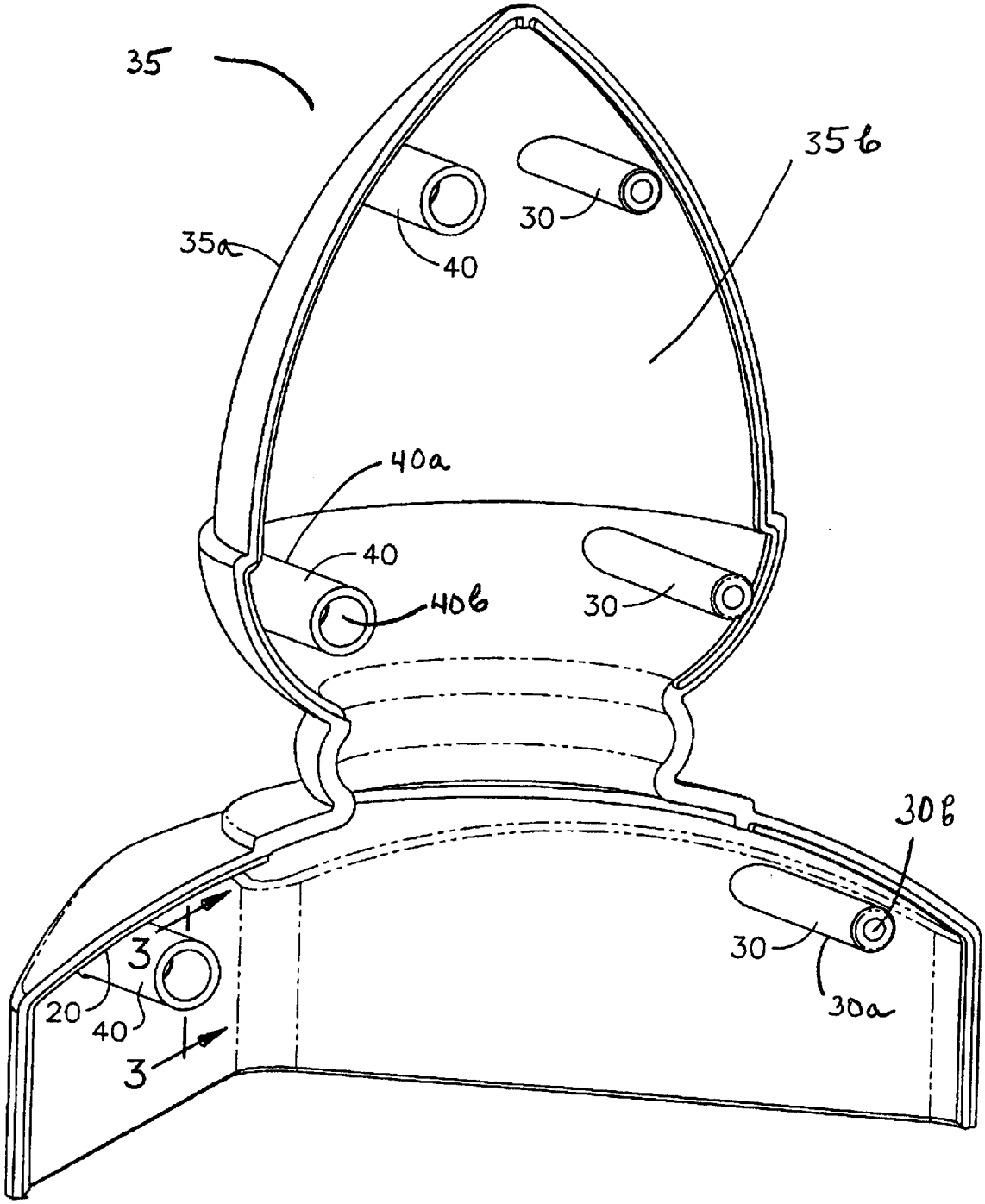
FIG. 2 is an isometric view of the interior of one-half of an acorn-shaped fence post finial.
Figure 3:
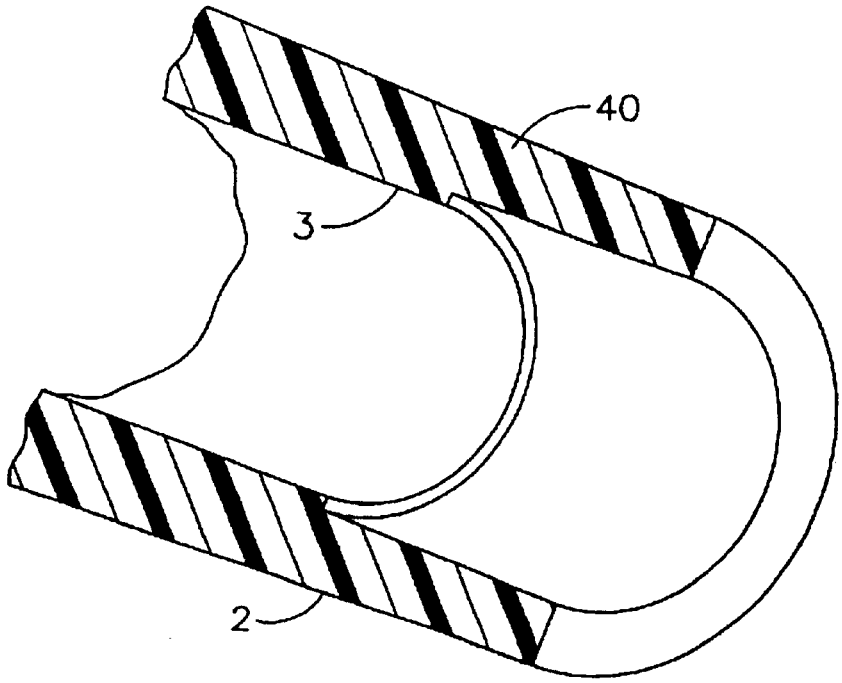
FIG. 3 is an isometric section view of the interior of a receptor without venting; this illustration is a section view taken along lines 3—3 of FIG. 2.
Figure 5:
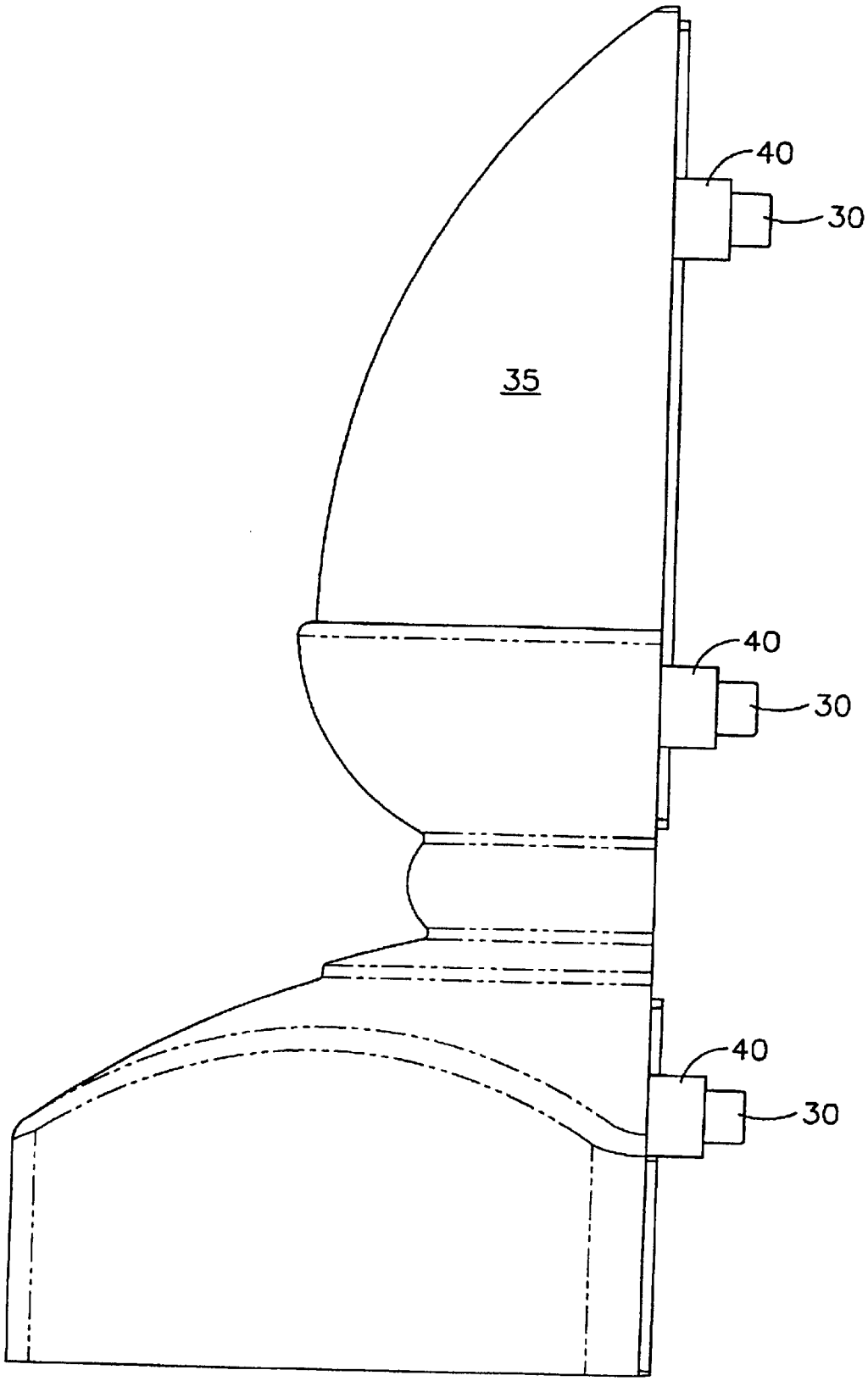
FIG. 5 is a side, isometric view of one-half of an acorn-shaped fence post finial.
Figure 6:
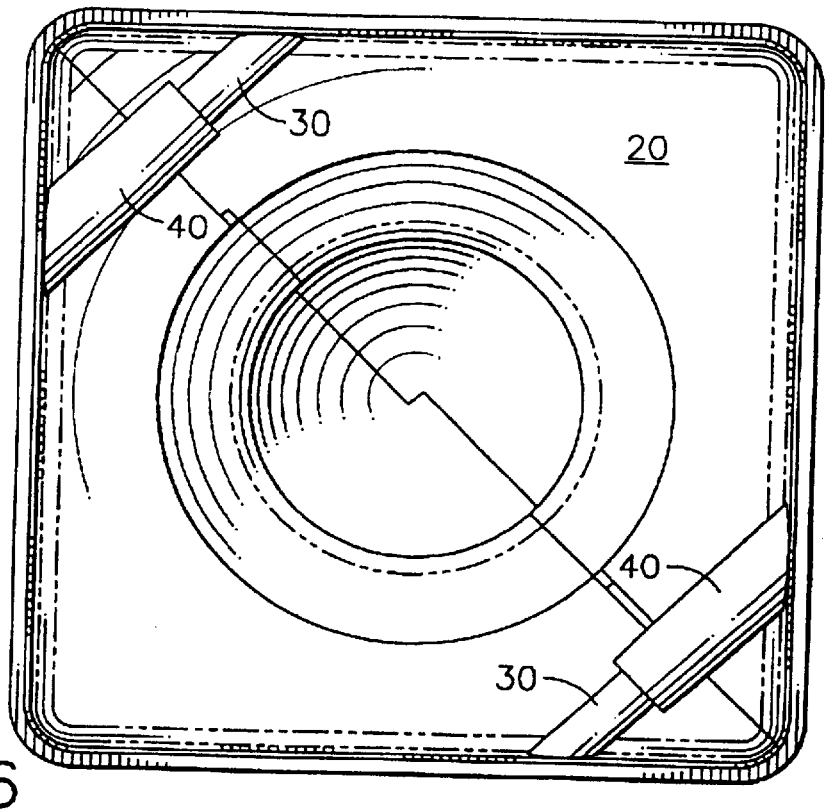
FIG. 6 is a bottom view of the interior of an assembled acorn-shaped fence post finial.

Referring to FIGS. 2 and 5, one embodiment of the current invention adopts a "unisex" concept. Each half of the finial (35) is substantially similar by being formed in the same or similar mold. The molds form hollow halves that are fitted together (See FIG. 6). The mold contains both at least one male (30-peg) and at least one female (40-receptor) elements. When two unisex halves are assembled face to face **(35*b*), the pegs (30) on one half align with the receptors (40) on the opposite half. The finished finial comprises two substantially similar, unisex halves that are fitted together to create a single finial. The most common styles include bases, spheres, squares, pyramidial, and acorns. The finished finial (35) may comprise many numerous shapes and sizes conducive to injection molding in two separate pieces. Each half comprises interior (35*b*) and exterior (35*a*)** components that are more fully described in the following.

The interior **(35*b*) of the finial (35) is molded to comprise at least one peg (30) and at least one receptor (40) displaced along the same horizontal plane. Additional peg-receptor pairs (30–40) may be displaced in vertical, but not necessarily symmetrical, alignment with the other peg-receptor pairs (30–40) along the interior surface (35*b*) of the unisex half. Preferably, the pegs (30) and receptors (40) are hollow. The peg (30) comprises an outer shell (30*a*) and a hollowed portion (30*b*). The receptor (40) comprises an outer shell (40*a*) and a hollowed portion (40*b*)**.

The hollows **(30*b*, 40*b*) are sized in relation to the diameter of each component to approximate common rates of shrinkage or expansion between the peg element (30) and the receptor element (40). Once pressure-fitted, the peg (30) and receptor (40)** will tend to shrink/expand at the same rate; therefore, an adequate level of pressure will be maintained to hold the two halves together even if the exact level of pressure-fit initially achieved is not maintained. The tooling required to construct molds that will achieve the desired pressure-fit may be determined using shrink fit formulas for the desired finial material that are given by the materials supplier (these shrinkage factors may also be found in plastics engineering manuals). The development of this tooling is well known in the art of injection molding. The cavities for the molds are preferably constructed from stainless steel. However, the cavities may also be constructed from steel coated with nickel or aluminum. The mold cavities may be polished with diamond dust to help maintain the high gloss of the finished molds. It must be noted that the molding process will vary over long runs. Periodic testing and adjusting of the molding machine will be required to achieve consistency in the molded components. If the material is not dry enough or it is not packed out consistently tight, diameters may vary. No part of this process is so exact that one simple formula will give precise results. Rather, experimentation will be required to develop the finished molds.

The pressure fitting of the finial halves requires that a certain dimension ratio be maintained between the peg (30) and the receptor (40) elements. The diameter of each does not matter as long as the two mating portions (30, 40) are sized appropriately together to maintain the desired ratio. By varying the fit tolerances, the amount of force required to push the two halves together and also pull them apart can be controlled. Determining the desired ratio is dependent upon the finial design and room available to place the elements. In the case of polyvinyl chloride (PVC), these ratios may be determined using the material friction constant of the PVC assuming some standard of finish, contact area, etc;

although, again, experimentation may be required to achieve an optimum fit. The development of the optimal ratio is within the knowledge of one skilled in the art of plastics.

The interior halves (35*b*) of the finial are then positioned such that the interiors of each half face each other. It will be noted that when the interior halves (35*b*) are positioned in this manner, because they are substantially similar, they effectively form mirror images of each other. Therefore, the at least one receptor (40) of the interior first half (35*b*) faces the at least one peg (30) of the interior second half (35*b*) and vice versa. The finial (FIG. 1, 35) is assembled by engaging the peg (30) of the first finial half into the complementary receptor (40) of the second finial half and vice versa. The fit between the hollow peg (30) and the hollow receptor (40) is determined by what pressure is desirable to force the two halves together without being able to freely pull them apart. The shapes themselves tend to resist pulling the two halves apart because the finial's outside shape is usually smooth and tapered (see FIGS. 1 and 7), enough to prevent gripping sufficient to pull the two halves apart. In the manufacturing process, the practical application of a pressing device using air pressure to clamp the two halves, maximizes productivity. A simple press with nests shaped to match the finial halves, and variable air pressure control, such as the press manufactured by the Merrick Machine Company under the name Pressfit, can be set up with minimal difficulty. The resultant "pressure fit" is merely the friction required to pull the two halves apart. Preferably, the resistance generated should be about 20 lbs. per peg with a window for error of between 15–25 lbs. per peg (30) and receptor (40) engagement. Where this level of resistance per engagement is desired, the halves may be forced together using approximately 100 psi. The machine will monitor the process of fitting the finial components together. Virtually any level of resistance may be used depending on the level of difficulty one wishes to achieve in pulling the unisex halves apart. If multiple peg/receptor (30, 40) combinations are used in a finial, considerable force would be required to separate the two halves after attaching the finial to a fence post. Manual assembly, with some effort, is a viable alternative for assembling the finial halves.

Figure 11:
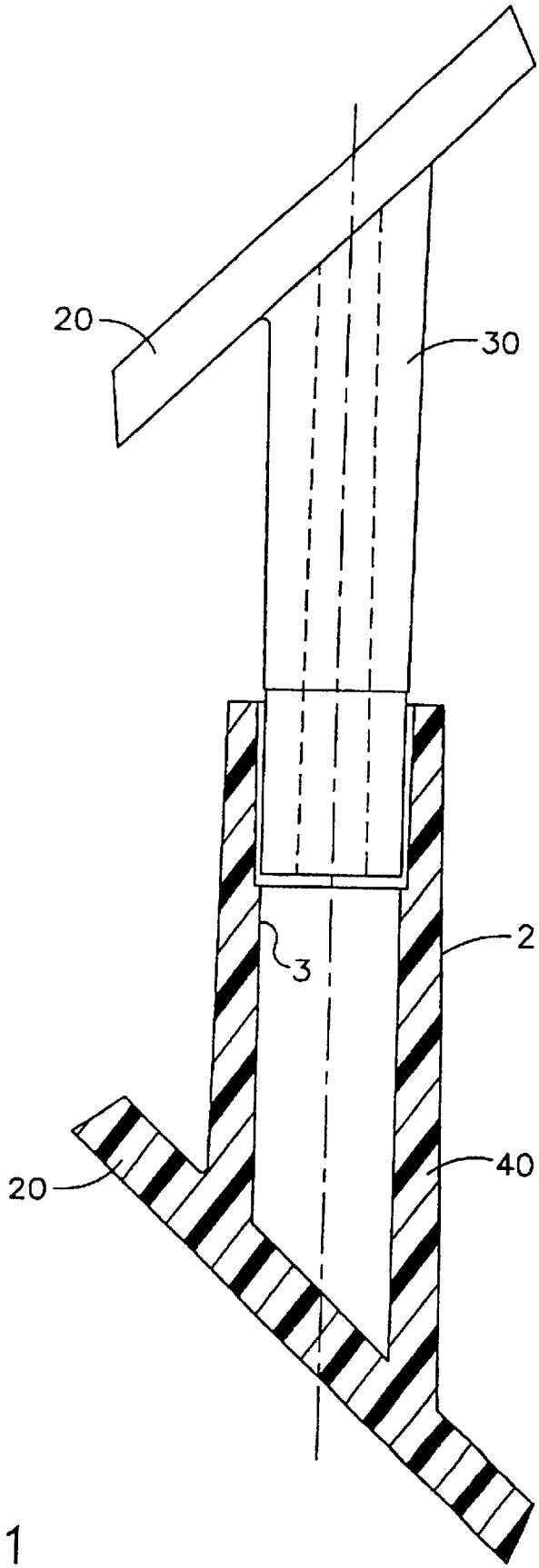
FIG. 11 is a view of a peg and receptor prior to full assembly.

The amount of resistance is determined by three variables: the ratio fit between the peg (30) and receptor (40) elements, the length of engagement, and the number of peg/receptor pairs in each finial. Where the desired resistance is about 20 pounds per peg (30)/receptor (40) combination, the length of engagement is about 0.250", the preferred ratio fit between the two elements is about 0.0015". The fewer peg/receptor elements a finial contains, the greater the desired resistance may be to ensure the finials remain interconnected. Some testing and experimentation with the actual parts may be required to establish the desired resistance depending on the finial's particular development environment. The peg (30) and receptor (40) may have a loose fit, as shown in the pre-assembled view in FIG. 11, for all but the chosen length of engagement (see FIG. 12). This allows easily starting the assembly by placing the two halves together without any resistance. In one embodiment of the invention, the peg is 0.010"to 0.015" narrower than its complementary receptor to allow a loose fit to start assembly. It is easier to modify the diameter of the peg (30) than of the receptor (40).

Temperature variances in different areas of the country may vary the force required to separate the two halves. The hollows in the peg (30) and receptor (40) elements allow the completed finial to maintain the pressure-fit as temperature rises or falls by counteracting any adverse expansion or contraction effects between the peg (30) and receptor (40). Thus, this method achieves a more durable polyvinyl chloride fence post finial. If materials other than PVC are used (such as other plastics or metal), different material friction constants should be utilized to determine a base ratio fit and further experimentation may be necessary to achieve an optimum fit.

Figure 12:
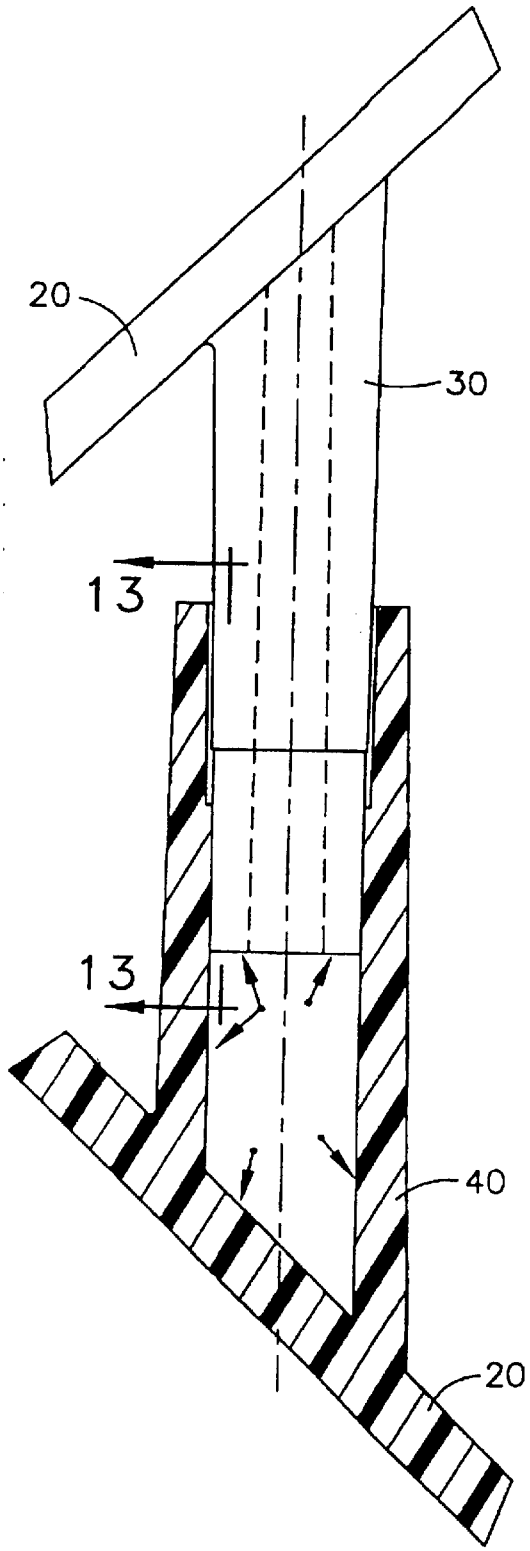
FIG. 12 is a view of a peg and receptor, without venting, after assembly.
Figure 13:
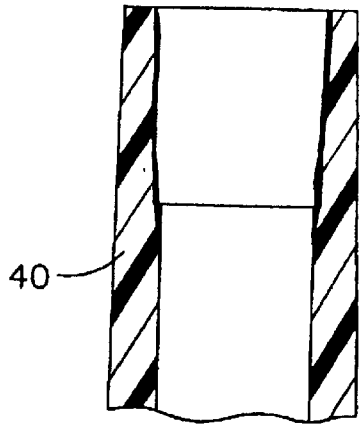
FIG. 13 is a section view along lines 13—13 of FIG. 12.

The loose fit assembly is then put together either manually or with the aid of a pressing machine. Referring to FIG. 12 and 13, the clamping only forces the halves along the length of engagement (wherever this occurs along the route of the peg and receptor) to seat the two halves together. Designing the peg (30) to be shorter than its complementary receptor (40) eliminates possible length mismatching, which could cause clamping short of seating both halves completely.

Figure 4:
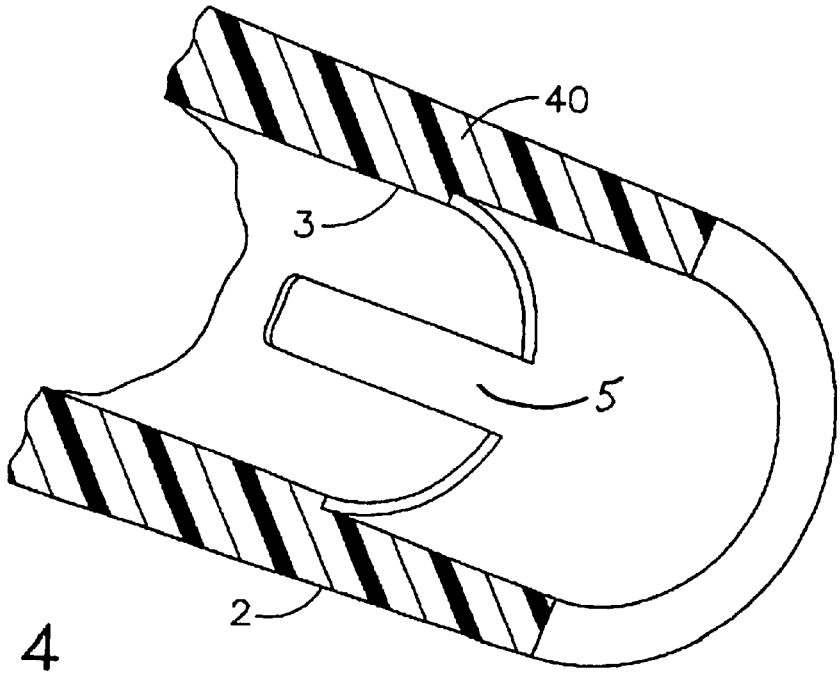
FIG. 4 is an isometric section view of the interior of a receptor with venting.
Figure 14:
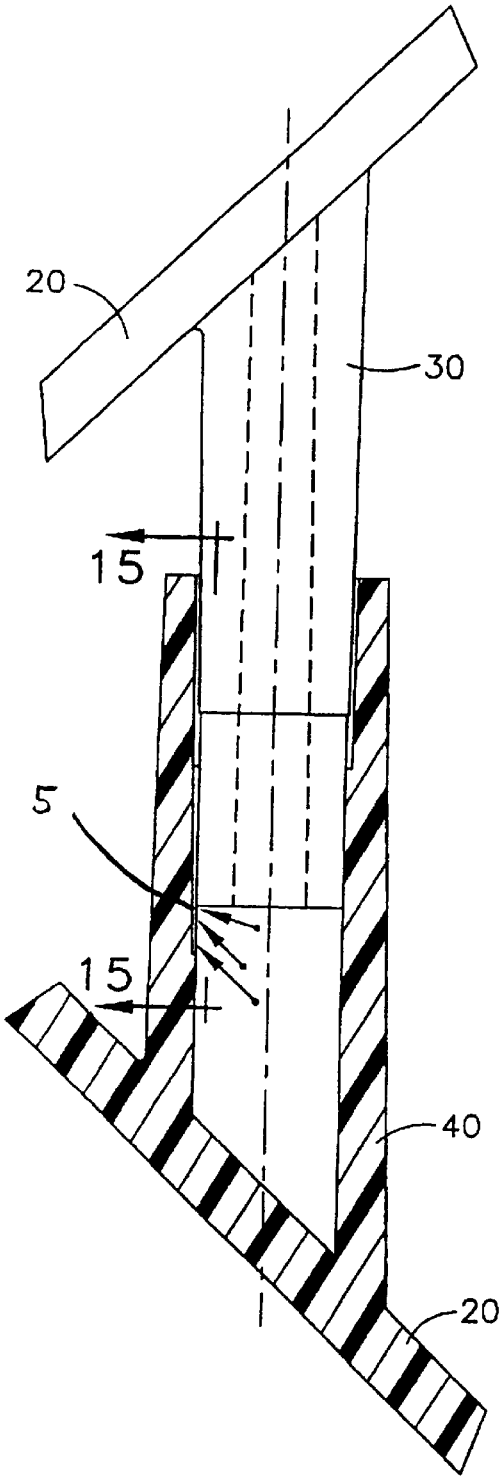
FIG. 14 is a view of a peg and receptor, with venting, after assembly.
Figure 15:
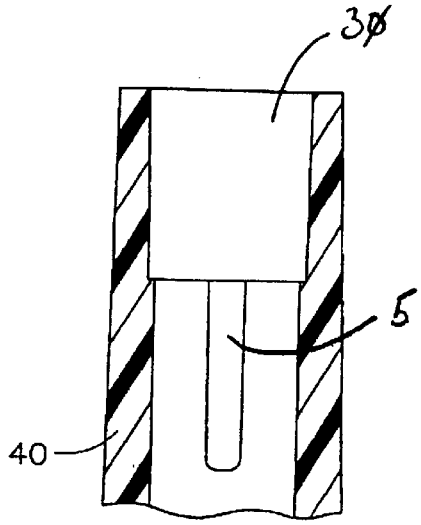
FIG. 15 is a section view taken along lines 15—15 of FIG. 14.

Referring to the embodiment depicted in FIGS. 4, 14, and 15, the assembling of the finial halves may be improved by allowing air trapped by the mating of a blind peg/receptor (30, 40) combination to escape through a variety of mechanisms. Preferably, a venting or groove (5) may be provided along the outside surface (30*a*) of the peg component (30) or along the inside surface (40*b*) of the hollow receptor component (40). The groove (5) can run the entire length of the receptor (30) or peg (40) but it is only necessary to run slightly beyond the length of engagement between the receptor/peg (30, 40). In an alternative embodiment, the peg/receptor elements may be designed such that one element comprises a round and the other element comprises an oval. In yet another alternative embodiment, the peg element may comprise a square and the receptor element may comprise a round. In yet another embodiment, the length of either the peg (30) or receptor (40) element could be designed to allow ample space when fully engaged and the trapped air may compress within the gap and not need to escape. Finally, in another embodiment, either the peg (30) or receptor (40) element may be designed with vent holes to allow air to escape.

This improves the assembling process because air trapped in the cavity of the hollow receptor as the peg is forced into it exerts a pressure hindering the mating of the receptor and peg components (see FIG. 12). By providing the venting enhancement, the finial halves may be assembled using less force and fewer clamping strokes.

Figure 16:
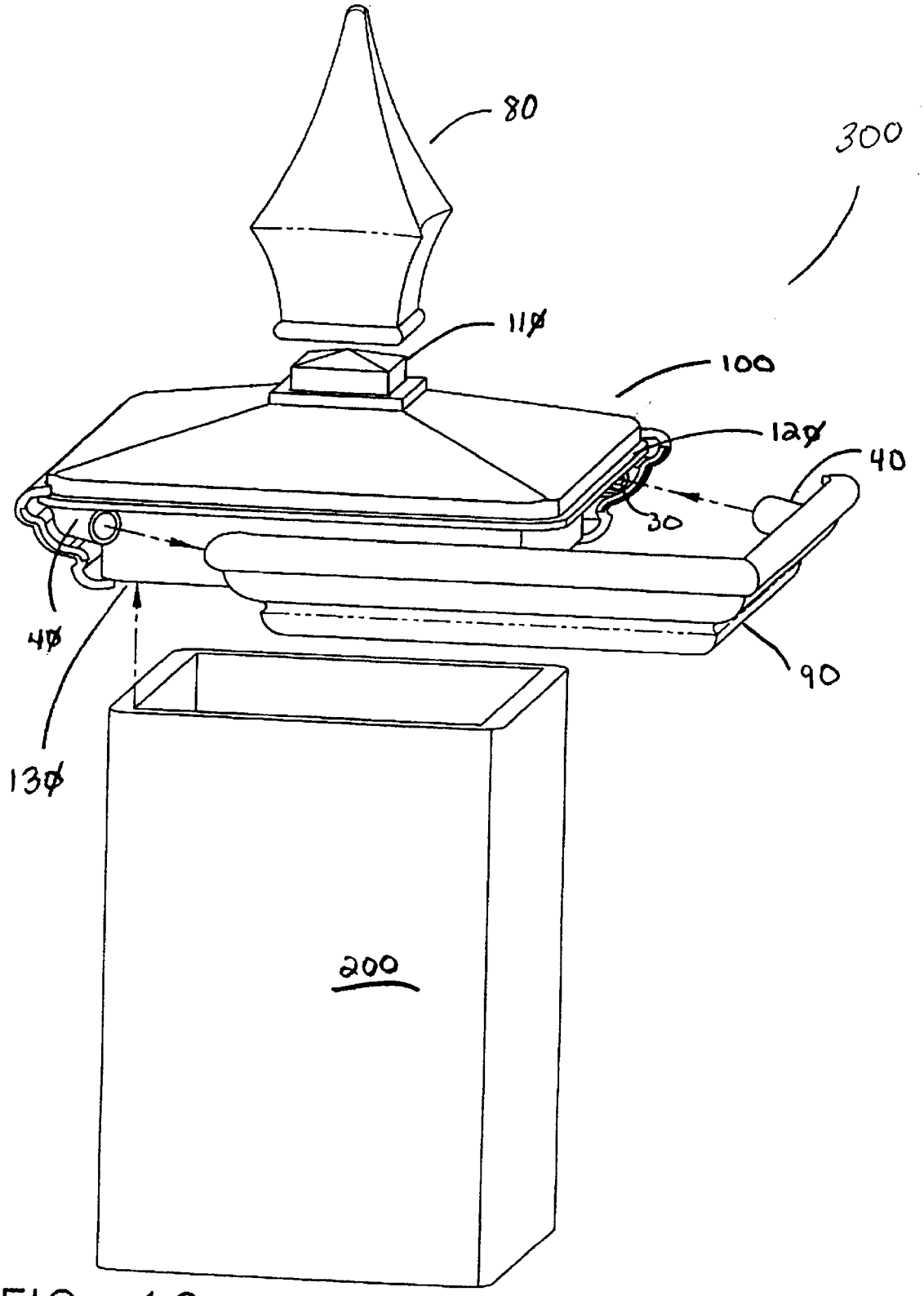
FIG. 16 is an exploded view of the assembly of a fence post, cover, skirt, and decorative top.
Figure 17:
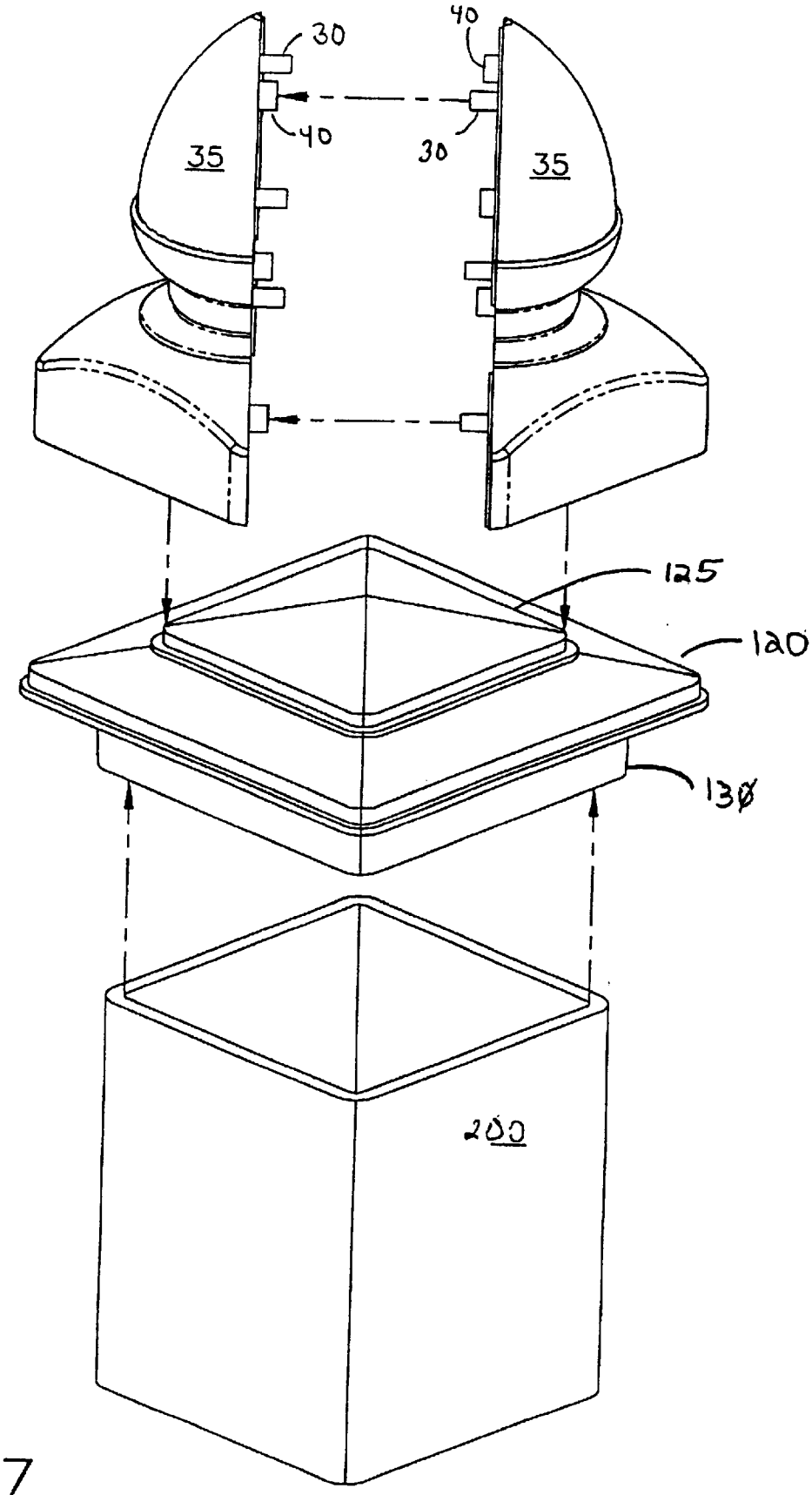
FIG. 17 is an exploded view of the assembly of a fence post, cover, and supplemental cover.

FIGS. 16–17 illustrate how the exterior of the finial molds are designed to allow the placement of additional finials (via protrusions (110, 125) or recessions (75)) either on top of or beneath the assembled finial/decorative elements. Some decorative elements may not employ the pressure-fitted unisex halves but simply be designed to allow placement upon another finial's protrusion. In one embodiment, a 4" finial sized to fit on a standard 4" fence post would also fit upon a 5" finial that fits a 5" fence post and has a 4" protrusion. The dimensions of the base (130) of the finial (35, 100) may be varied to fit any fence post. The dimensions of other components of the finial may be sized in any manner during the molding process to allow various combinations.

Additional decorative elements (70, 80, and 35) may be further secured to the base finial by an adhesive such as glue. In other embodiments, the underside (120) of the exterior of the assembled fence post finial (100) is adapted to receive a decorative skirt (90). This skirt (90) is designed to surround elements of the base finial (100) and lock into place, using the pressure fit system. The skirt (90) is supplied in two halves and assembled by forcing the two halves together as the are lined up with specific elements (120) of the base finial (100). Once pressure-fitted into position the skirt (90)

will remain affixed to the base finial (100) as locked by the base finial elements (120). The skirt (90) may also be turned upside down and used to surround a fence post near or at the base, acting as a decorative trim on porch railing or deck railing. These designs may allow one or more differently designed and sized finial tops, to be affixed to each finial, thus, creating an otherwise impossible combination that appears extremely attractive and decoratively ornate.

FIG. 16 specifically illustrates the assembly of a fence post finial (300) comprising a base finial (100) with an attached decorative skirt (90). The base finial (100) comprises a collar or apron capable of receiving an appropriately sized fence post (200). The base finial (100) further includes an outer lip (120) protruding from the base finial (100) capable of receiving a skirt (90). In a preferred embodiment, the lip (120) comprises a protrusion extending along the perimeter of the base finial (100), however, it may also comprise a series of protrusions extending along the perimeter of the base finial (100). A decorative skirt (90) may be attached to the base finial (100) by placing the skirt (90) over the lip and locking the skirt (90) together via its peg (30) and receptor (40). The decorative portion of the skirt (90) may extend to cover the collar (130) of the base finial (100).

As shown in FIG. 17, the base finial (100) is designed such that the top of the base finial (100) comprises a pedestal protrusion (110) capable of supporting an additional appropriately sized decorative finial (35) or cover (80). Further decorative elements (100, 80) are stacked upon one another and, preferably, affixed to one another by an adhesive such as glue. A fence post (200) could receive the base finial (100 or 35), a decorative finial (80), a skirt (90), or some combination/multiple thereof to achieve an elaborate enhancement to known fence post covers. The collar (130) of the base finial (100) may be designed to be inserted into or over the fence post (200).

In summary, numerous benefits have been described which result from employing the concepts of the invention. The foregoing description of preferred embodiments to the invention has been presented for the purpose of illustration and description. It is not intended to be exhaustive or to limit the invention to the precise form disclosed. Obvious modifications or variations are possible in light of the above teachings. The embodiment was selected and described in order to best illustrate the principles of the invention and its principal application to hereby enable one of ordinary skill in the art to best utilize the invention in various embodiments and with various modifications as are suited to the particular use contemplated. It is intended that the scope of the invention be defined by the claims appended hereto.

What is claimed is:

1. A cover configured for covering an upper end of a post, the cover comprising:

a collar for placement upon the upper end of a post;

a domed protrusion capable of receiving an additional decorative element;

two substantially similar unisex halves each comprising:

at least one receptor having a hollow interior and a groove displaced along a portion of the interior hollow surface of said receptor;

at least one peg; having a hollow interior wherein said at least one receptor and said at least one peg are displaced in horizontal alignment with one another;

wherein said unisex halves are combined by fitting said at least one peg of a first unisex half with a complimentary receptor of a second unisex half and said at least one receptor of said first unisex half with a complimentary peg of said second unisex half wherein said combination of said unisex halves results in an engagement between said complimentary pegs and receptors along at least a portion of the engaged pegs and receptors.

2. The cover of claim 1 wherein said unisex halves comprise a polymeric material.

3. A cover configured for covering an upper end of a post, the cover comprising:

a collar for placement upon the upper end of a post;

a domed protrusion capable of receiving an additional decorative element;

two substantially similar, unisex halves each comprising:

at least one receptor;

at least one peg having a groove displaced along a portion of the exterior surface of said peg;

wherein said at least one peg and said at least one receptor comprise hollow interiors wherein said at least one receptor and said at least one peg are displaced in horizontal alignment with one another;

wherein said unisex halves are combined by fitting said at least one peg of a first unisex half with a complimentary receptor of a second unisex half and said at least one receptor of said first unisex half with a complimentary peg of said second unisex half wherein said combination of said unisex halves results in an engagement between said complimentary pegs and receptors along at least a portion of the engaged pegs and receptors.

4. The cover of claim 3 wherein said unisex halves comprise a polymeric material.

5. A cover configured for covering an upper end of a post, the cover comprising:

a collar for placement upon the upper end of a post;

a domed protrusion capable of receiving an additional decorative element;

two substantially similar, unisex halves each comprising:

at least one receptor;

at least one peg;

wherein said at least one peg and said at least one receptor comprise hollow interiors wherein said at least one receptor and said at least one peg are displaced in horizontal alignment with one another;

wherein said unisex halves are combined by fitting said at least one peg of a first unisex half with a complimentary receptor of a second unisex half and said at least one receptor of said first unisex half with a complimentary peg of said second unisex half wherein said combination of said unisex halves results in an engagement between said complimentary pegs and receptors along at least a portion of the engaged pegs and receptors and wherein said engagement, between said complimentary pegs and receptors, results in the escape of air trapped between said pegs and said receptors.

6. The cover of claim 5 wherein said unisex halves comprise a polymeric material.

* * * * *